US006536184B1

(12) United States Patent
Sting et al.

(10) Patent No.: US 6,536,184 B1
(45) Date of Patent: Mar. 25, 2003

(54) ENVELOPE-FILLING APPARATUS FOR MAIL-PROCESSING MACHINES

(75) Inventors: Martin Sting, Bad Vilbel (DE); Christian Botschek, Rodermark (DE)

(73) Assignee: Pitney Bowes Technologies GmbH, Friedberg (DE)

( * ) Notice: Subject to any disclaimer, the term of this patent is extended or adjusted under 35 U.S.C. 154(b) by 299 days.

(21) Appl. No.: 09/635,446

(22) Filed: Aug. 10, 2000

(30) Foreign Application Priority Data

Aug. 12, 1999 (DE) ..... 199 38 069

(51) Int. Cl.[7] ..... B65B 61/20

(52) U.S. Cl. ..... 53/284.3; 53/323; 53/569; 53/252

(58) Field of Search ..... 53/284.3, 284.4, 53/284.5, 323, 569, 252

(56) References Cited

U.S. PATENT DOCUMENTS 4,720,960 A * 1/1988 Green
5,284,004 A * 2/1994 Metzler ..... 53/569
5,457,935 A * 10/1995 Kope ..... 53/252
6,289,658 B1 * 9/2001 Sting et al. ..... 53/569

FOREIGN PATENT DOCUMENTS

DE WO 99/01295 1/1999

* cited by examiner

*Primary Examiner*—Eugene Kim
*Assistant Examiner*—Sameh Tawfik
(74) *Attorney, Agent, or Firm*—Michael J. Cummings; Charles R. Malandra, Jr.; Angelo N. Chaclas

(57) ABSTRACT

In an envelope-filling apparatus for mail-processing machines, the adjustment of the push-in depth of enclosures into open envelopes in the operating stroke of a pivot-lever arrangement, which bears a push-in-finger arrangement, is simplified in that said pivot-lever arrangement is designed as a three-lever rectilinear-guidance mechanism, of which the third lever, which serves as the carrier hand for the push-in-finger arrangement, has, at its free end, a slide guide which can be secured and is intended for adjusting the distance between a push-in-finger shaft for the push-in-finger arrangement and the point of articulation of the longer lever of the three-lever rectilinear-guidance means on the carrier hand.

3 Claims, 2 Drawing Sheets

ENVELOPE-FILLING APPARATUS FOR MAIL-PROCESSING MACHINES

TECHNICAL FIELD

The invention relates to an envelope-filling apparatus for mail-processing machines, having:

a carrier hand which is connected to a machine framework such that it can be pivoted via a pivot-lever arrangement;

a pivot drive which acts on the pivot-lever arrangement and causes the carrier hand, to move back and forth;

a push-in-finger arrangement which is connected pivotably to the carrier hand and, in a guide-controlled manner, can be lowered in an operating stroke, and raised in a return stroke, relative to the carrier hand, as the latter moves back and forth, and is loaded in the direction of the lowered position by prestressing means;

a baseplate onto which enclosures which are to be inserted into envelopes are conveyed and over which the push-in-finger ends, loaded by the prestressing means, are guided; and an envelope-feed arrangement which conveys envelopes into a region in the vicinity of the baseplate and holds said envelopes ready in the open state for the insertion of enclosures.

BACKGROUND ART

Conventional envelope-filling apparatuses contain, as the pivot-lever arrangement, a pivot lever which is mounted pivotably on the framework at the top end and of which the bottom end is designed as a carrier hand for the mounting of a push-in-finger arrangement. A sufficient length of the pivot lever achieves the situation where the bottom end of the pivot lever, during pivoting movements produced by the pivot drive, describes a circle arc of sufficiently large radius, with the result that the pivot pin of the pivot-lever arrangement, in the operating stroke, is moved over the baseplate of the envelope-filling apparatus at a distance which, during the pivoting movement of the pivot lever, only changes to an extent for which it is possible to compensate by the push-in fingers, loaded by prestressing means, of the push-in-finger arrangement, with the result that an enclosure which is to be inserted into an envelope can be pushed, by the free ends of the push-in fingers, from the baseplate into open envelopes.

In certain cases, for example with differing thicknesses of an enclosure stack which is to be inserted into envelopes and/or with differing properties of the envelopes used and/or with it being possible for the format of the enclosures and of the envelopes to be changed within comparatively low limits, it is necessary to vary the operating-stroke length executed by the outer ends of the push-in fingers, that is to say the push-in depth executed.

Use has already been made of a push-in-finger arrangement in which the push-in fingers had a section which ran, in the vicinity of the ends thereof, approximately parallel to the baseplate in terms of the positioning during the operating stroke and along which push-in-finger elements were provided such that they could be adjusted and secured in the longitudinal direction of said section.

For the purpose of adjusting the push-in depth, it was necessary, in the case of this known design, to adjust individually the individual push-in elements on all push-in fingers, that is to say for example on three push-in fingers of a push-in-finger arrangement, in order, during the operating stroke of the push-in-finger arrangement, for an enclosure or an enclosure stack to be pushed to a greater or lesser extent into the envelope which is held,ready.

DISCLOSURE OF THE INVENTION

The object of the present invention is to configure an envelope-filling apparatus of the type defined in the introduction such that it is possible to adjust quickly and straightforwardly the depths to which enclosures or enclosure stacks can be pushed into an open envelope, it being possible for said push-in depths to be changed within predetermined limits.

This object is achieved according to the invention by the features of the accompanying claim 1. Advantageous configurations and developments are characterized in the claims subordinate to claim 1 and, without the wording thereof being repeated here specifically, the contents of these claims hereby expressly form a constituent part of the description.

It should be noted here that the design of the pivot-lever arrangement of an envelope-filling apparatus as a three-lever rectilinear-guidance mechanism is known per se, but that the use of a three-lever rectilinear-guidance mechanism in the present case combines very advantageously with the rest of the characterizing features of the accompanying claim 1 since the change in the distance between the point of articulation of the carrier hand to the longer lever and the point of articulation of the carrier hand for the push-in-finger arrangement in the three-lever rectilinear-guidance mechanism has comparatively little influence on the rectilinear-guidance property in particular at the end of the operating stroke and, consequently, the satisfactory guidance of the push-in-finger arrangement is not put at risk by the adjustment.

For this reason, it is not necessary, during the common adjustment of the push-in depth of the push-in-finger arrangement, to select, instead of a pivot-lever arrangement, an actuating apparatus, for the pivot-lever arrangement, with highly geometrical rectilinear guidance and the associated, increased technical outlay.

BRIEF DESCRIPTION OF THE DRAWINGS

An exemplary embodiment of the envelope-filling apparatus specified here is explained in more detail hereinbelow with reference to the drawing, in which.

DETAILED DESCRIPTION OF THE INVENTION

Figure 1:
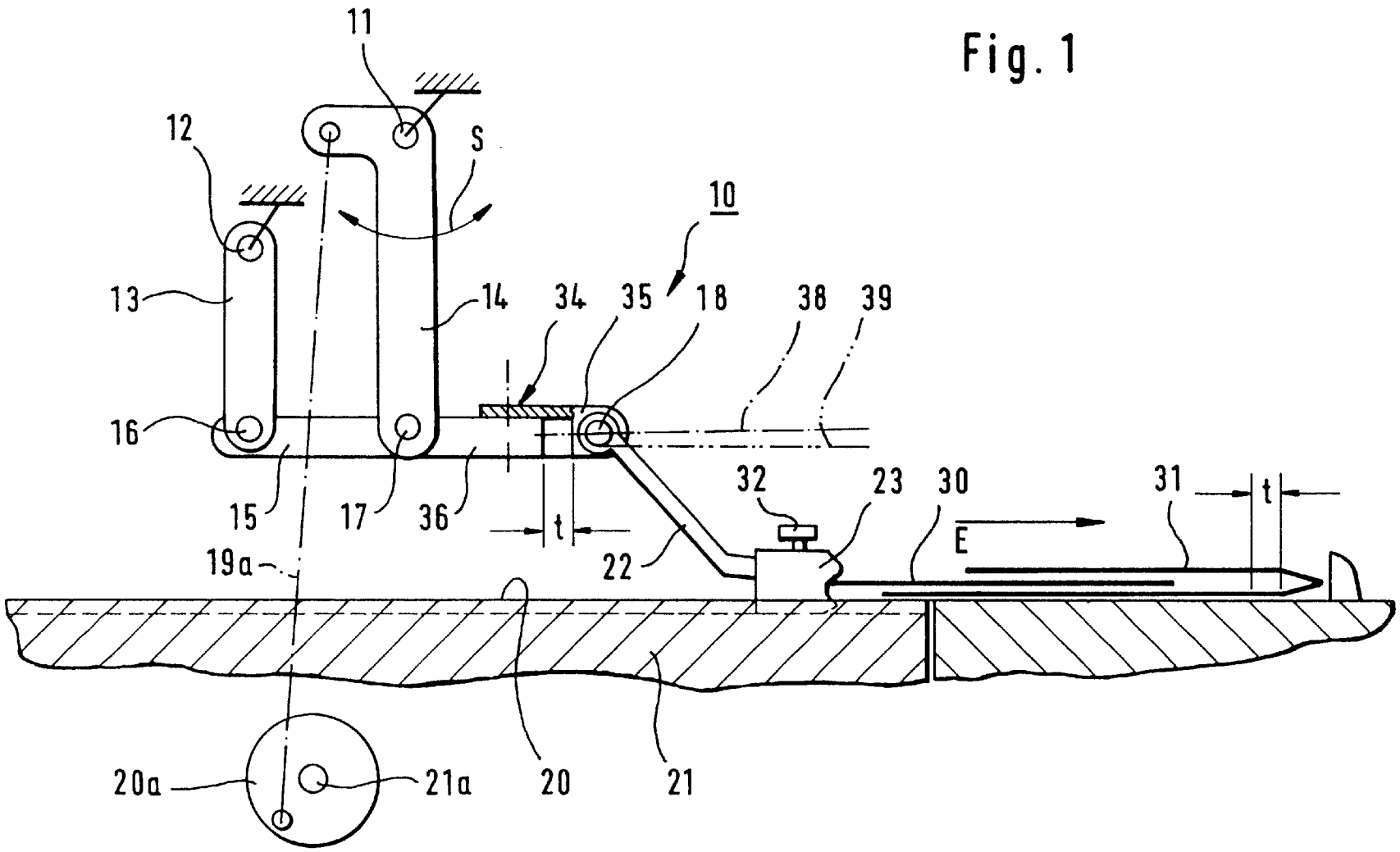
FIG. 1 illustrates a schematic, sectionally depicted side view of one embodiment of an envelope-filling apparatus of the type specified here.

The envelope-filling apparatus which is designated in general terms by 10 in FIG. 1 contains a pivot-lever arrangement which is mounted on a machine framework via two pins 11 and 12, oriented transversely to the envelope-filling direction or push-in direction according to the arrow E, and is in the form of a three-lever rectilinear-guidance mechanism. The latter contains a short lever 13 and an angle lever 14, with a leg of longer length than the lever 13, and a double-armed lever 15, which has one end connected in an articulated manner at 16 to the lever 13 and, in the region between its ends, is connected in an articulated manner at 17 to the bottom end of the long leg of the angle lever 14 and, at its end remote from the point of articulation 16, is provided with bearings for a push-in-finger shaft 18.

The short leg of the angle lever 14 is connected, via a coupling rod 19, to a crank 20*a* which is set in rotation by a crankshaft 21*a*, coupled to a drive motor, such that the pivot-lever arrangement, which forms the three-lever rectilinear-guidance mechanism, is caused to pivot in accordance with the double arrow S.

On account of the pivot pins 11 and 12 being positioned on the machine framework in a manner known per se, of a certain selection of the lengths of the levers between the points of articulation 12 and 16 and 11 and 17, and of a certain selection of the distances between the points of articulation 16 and 17 and the push-in-finger shaft 18 in relation to one another in each case, the situation is achieved where, during pivoting of the levers 13 and 14, the push-in-finger shaft 18 is moved horizontally at an essentially constant height over the surface 20 of a baseplate 21 in the push-in direction or envelope-filling direction, according to the arrow E, or counter thereto.

Fastened on the push-in-finger shaft 18 are a plurality of push-in fingers 22 which bear push-in elements 23 at their outer ends.

Figure 2:
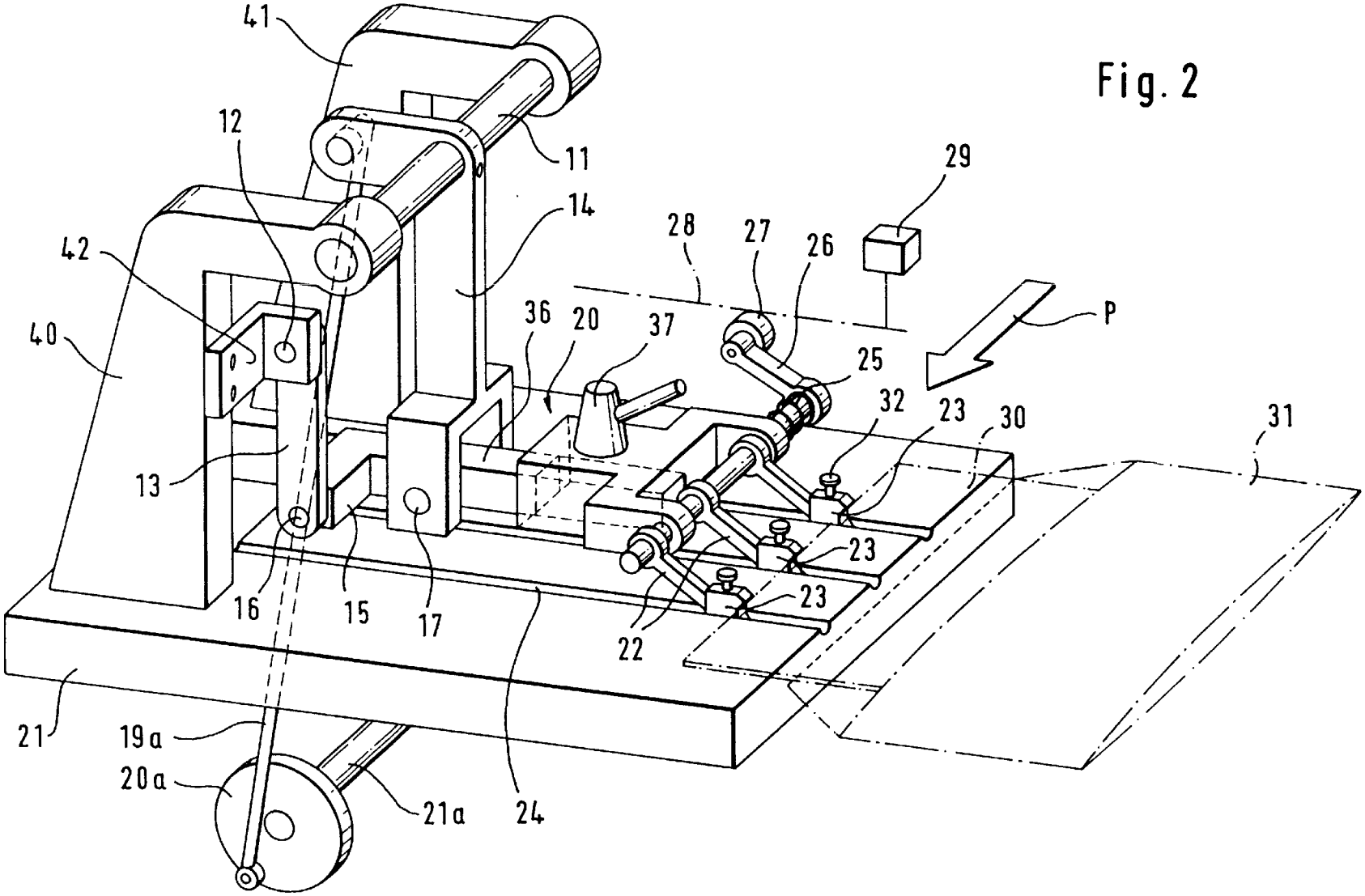
FIG. 2 illustrates a perspective, again partially schematically depicted apparatus of the type illustrated in FIG. 1.

Prestressing means prestress the push-in fingers 22 in the clockwise direction in relation to that position of the individual parts which is shown in FIGS. 1 and 2, with the result that the push-in elements 23 are retained in grooves 24 of the baseplate 21 when the three-lever rectilinear-guidance mechanism moves forwards, with the effect of executing an operating stroke, in the direction of the arrow E. In the embodiment shown, the prestressing means for producing said mechanical prestressing are in the form of a helical spring 25 which wraps around the push-in-finger shaft 18 and has one end anchored on the front part of the lever 15, which may be referred to as the carrier hand, and has its other end supported on a guide contact lever 26 which is fastened at one end of the push-in-finger shaft 18 and bears a guide contact roller 27. Said guide contact roller 27 interacts with a guide strip 28 which is only indicated schematically as a chain-dotted line in FIG. 2 and, by means of an actuating drive 29, is raised approximately parallel to itself first into the position shown in FIG. 2 while the apparatus executes its operating stroke, and then is lowered in relation to the position shown in FIG. 2 when the apparatus executes its return stroke. If the guide strip 28 has been lowered by the actuating drive 29 in relation to the position shown in FIG. 2, then the guide contact roller 27 follows correspondingly, pivoting the guide contact lever 26 counter to the force of the prestressing means 25 in the process. The push-in fingers 22 and the push-in elements 23 are then raised for the return stroke of the apparatus. Once this has taken place, it is then possible for enclosures or documents which are to be inserted into envelopes on a level above the plane of the surface 20 of the baseplate 21 to be conveyed onto the baseplate 21, for which purpose use is made, for example in a manner known per se, of conveying apparatuses which are not shown in the drawing. The enclosures which are to be inserted into envelopes may be fed from the direction of the arrow P, but also from a direction counter to the arrow P or else, beneath the lever 15, from a direction perpendicular to the arrow P. If an enclosure, or a set of enclosures, which is to be inserted into an envelope is located on the baseplate 21, then the guide strip 28 is raised by the actuating drive 29. The push-in fingers 22 and the push-in elements 23 are lowered downwards under the spring force of the helical spring 25 since the guide contact roller 27 on the guide contact lever 26 can yield upwards. As the rotation of the crankshaft 21 continues, the operating stroke of the envelope-filling apparatus then begins. The push-in elements 23 are positioned against the trailing edge of an enclosure 30 which is to be inserted into an envelope and push the enclosure into an open envelope 31. During the return stroke, the guide strip 21 is then lowered again, the push-in fingers 22 and their push-in elements are pivoted upwards, and the operating cycle can be repeated.

The ends of the push-in fingers 22 are angled approximately in a horizontal direction and, on said ends, the push-in elements 23 can be displaced in the longitudinal direction and secured by means of adjusting screws 32. This configuration allows precision alignment of the push-in elements 23 to the profile of the trailing edge of an enclosure 30 which is to be inserted into an envelope. If, however, the desire is to achieve different push-in depths by adjustment of the push-in elements 23 on the ends of the push-in fingers 22, for example in the case of somewhat different formats of the enclosures 30 which are to be inserted into envelopes or in the case of a different thickness of a set of enclosures or else in the case of an envelope 31 behaving differently during the envelope-filling operation, then this requires a considerable amount of time and operational outlay and comparatively long standstill of the envelope-filling machine. In order to avoid this, with the design specified here, that part of the double-armed lever 15 which may be referred to as the carrier hand is designed such that it can be adjusted in length between the points of articulation 17 and 18. For this purpose, the third lever 15 of the three-lever rectilinear-guidance means, between the point of articulation 17 to the long lever 14 and the point of articulation or the mounting for the push-in-finger shaft 18, has a slide guide 34 which can be secured and is provided between a carrier-hand front part 35 and a carrier-hand rear part 36.

It can be seen from FIG. 2 that the carrier-hand front part 35, which in its front region is designed as a bearing fork for the push-in-finger shaft 18, is provided, on its underside, with a groove for receiving a projecting carrier of the lever 15 and, by means of a securing screw 37 provided with a grip, can be secured in certain displacement positions in relation to the carrier 36. For this purpose, regions of the carrier-hand front part 34 or of the carrier 36 of the lever 15 may be provided with a through-slot, as will be familiar to the person skilled in the art.

If the slide guide 34 is adjusted in accordance with a distance t, depicted in FIG. 1, for the purpose of extending the distance between the points of articulation 17 and 18, this results in an increased push-in depth in the operating stroke of the push-in elements 23, with the result that enclosures 30 can be pushed into envelopes 31 to a greater extent, by a corresponding distance t.

It is worth noting, in the exemplary embodiment shown, that the three-lever rectilinear-guidance means, as far as the route of the axis of the push-in shaft 18 over the baseplate 21 is concerned, is affected to a comparatively small extent in relation to a length adjustment in the distance between the points of articulation 17 and 18, in particular in the end section of the operating stroke. This is indicated in FIG. 1 by the chain-dotted line 38, which applies to a very precise length adjustment of the lever 15 for bringing into line with the rectilinear guidance of the push-in-finger shaft 18, and by the chain-double-dotted line 39, which is shown for an extension of the front end of the lever 15 for producing a push-in depth which is greater by the distance t.

While, in the case of the embodiment shown in FIGS. 1 and 2, the length adjustment in the front part of the lever 15 is carried out manually on the slide guide 34 by release of the adjustment screw 37 and displacement of the carrier-hand front part 35 in relation to the carrier 36 and subsequent securing of the selected position, it is possible, according to an embodiment which is not shown in the drawing, for the effective distance between the points of articulation 17 and 18 also to be adjusted and secured by an actuating drive, activated for example via flexible control lines, such that it is also possible for the push-in depth to be changed during operation of the envelope-filling machine, that is to say in this case, for example, during a return stroke of the pivot-lever arrangement.

FIG. 2 shows details of a practical embodiment of the three-lever rectilinear-guidance system which has two angled side bearing elements 40 and 41 which project from the baseplate 21 and are intended for mounting the pivot shaft 11 for the angle lever 14, which has the longer lever leg. Fastened on the side bearing element 40 is an angled link plate 42 which bears the mounting 12 for the shorter lever 13. The design shown has the advantage that the double-armed lever 15 can pivot freely upwards in the return stroke, and that the region directly above the surface 20 of the baseplate 21 is kept free of structural parts for mounting the pivot-lever arrangement, such that enclosures which are to be inserted into envelopes may be conveyed, if appropriate also in relation to that position of the parts of the apparatus which is shown in FIGS. 1 and 2, from the left onto the baseplate 21 in order then, for envelope-filling purposes, to be able to be gripped by the push-in elements 23 and pushed into the envelopes 31.

What is claimed is:

1. Envelope-filling apparatus (10) for mail-processing machines, having a carrier hand (15) which is connected to a machine framework such that it can be pivoted via a pivot-lever arrangement;

a pivot drive (21*a*, 20*a*, 19) which acts on the pivot-lever arrangement and causes the carrier hand to move back and forth;

a push-in-finger arrangement (22) which is connected pivotably to the carrier hand (15) and, in a guide-controlled manner (26, 27, 28, 29), can be lowered in an operating stroke, and raised in a return stroke, relative to the carrier hand, as the latter moves back and forth, and is loaded in the direction of the lowered position by prestressing means (25);

a baseplate (21) onto which enclosures which are to be inserted into envelopes are conveyed and over which the push-in-finger ends (23), loaded by the prestressing means (25), are guided; and an envelope-feed arrangement which conveys envelopes (31) into a region in the vicinity of the baseplate (21) and holds said envelopes ready in the open state for the insertion of enclosures;

characterized in that the pivot-lever arrangement (13, 14, 15) is formed by a three-lever rectilinear-guidance mechanism which is known per se, has the top ends of a short lever (13) and of a long lever (14) connected to framework-mounted points of articulation (12, 11) and has the bottom ends of the short lever and of the long lever connected in an articulated manner (16, 17) to a third, carrier-hand-forming lever (15) of the three-link rectilinear-guidance mechanism;

a point of articulation (18) of the push-in-finger arrangement (22) on that side of the point of articulation (17) of the long lever (14) which is located opposite the point of articulation (16) of the short lever (13) is arranged at the free end of the third lever (15), the lever lengths and the distances between the axes of the points of articulation being selected such that, when the pivot-lever arrangement pivots, the pin (18) of the point of articulation of the push-in-finger arrangement (22) moves essentially at a constant height over the baseplate (21), in the direction perpendicular to its axis, in the operating direction or in the return-stroke direction; and the third lever (15), between the point of articulation (17) to the long lever and the point of articulation (18) of the push-in-finger arrangement (22), has a slide guide (34) which can be secured and is intended for adjusting the distance between the two points of articulation in the push-in direction.

2. Apparatus according to claim 1, wherein on the carrier hand (15), a drive arrangement, for adjusting and securing the distance between the point of articulation (17) of the long lever (14) and the point of articulation (18) of the push-in-finger arrangement (22), is arranged on the third, carrier-hand-forming lever (15) and can be actuated by means of control lines, in particular during operation.

3. Apparatus according to claim 1 wherein the effective length of push-in fingers of the push-in-finger arrangement (22) can be individually adjusted (32).

* * * * *